US005793336A

United States Patent [19]

Shoemaker et al.

[11] Patent Number: 5,793,336

[45] Date of Patent: Aug. 11, 1998

[54] CONFORMAL ANTENNA ASSEMBLIES

[75] Inventors: Kevin O. Shoemaker, Lafayette; Randall P. Marx, Wheat Ridge, both of Colo.

[73] Assignee: Antennas America, Inc., Wheat Ridge, Colo.

[21] Appl. No.: 672,400

[22] Filed: Jun. 10, 1996

[51] Int. Cl.[6] ..... H01Q 9/26; H01Q 9/16

[52] U.S. Cl. ..... 343/795; 343/806; 343/790; 343/730

[58] Field of Search ..... 343/795, 790, 343/791, 792, 806, 821, 822, 796, 713, 725, 727, 729, 730; H01Q 9/26, 9/16

[56] References Cited

U.S. PATENT DOCUMENTS

| | | | |
|---|---|---|---|
| 2,821,710 | 1/1958 | Hale | 343/806 |
| 3,139,620 | 6/1964 | Leidy et al. | 343/792 |
| 4,543,583 | 9/1985 | Wurdack | 343/792 |
| 4,751,514 | 6/1988 | Sheriff | 343/717 |
| 4,987,424 | 1/1991 | Tamura et al. | 343/795 |
| 5,363,114 | 11/1994 | Shoemaker | 343/713 |

FOREIGN PATENT DOCUMENTS 2636523 2/1978 Germany .

*Primary Examiner*—Hoanganh T. Le

*Attorney, Agent, or Firm*—Ancel W. Lewis, Jr.

[57] ABSTRACT

A conformal antenna assembly disclosed has a first antenna portion sensitive to a UHF band of frequencies. A thin, flat, low-profile, weather-resistant housing encloses the first antenna portion. The housing has a conformal back surface that conforms to the shape of a support surface on which said housing is mounted. The housing has an arrangement to mount the housing to a support surface. In one form the housing is flat to mount on the side of a building and in another form is double curved to mount on the back of a satellite dish. A coaxial cable has a center conductor and a tubular outer conductor with an insulator between the conductors. The center conductor and outer conductor are connected at one end to the first antenna portion. The inner conductor terminates at the other end in an end terminal to conduct signals from the first antenna portion to the end terminal. The outer conductor has a gap which ungrounds said outer conductor at said end terminal so that the outer conductor is a second antenna portion sensitive to a VHF band of frequencies in combination with the first antenna portion to pick up local television stations for both UHF and VHF signals for off-air reception.

18 Claims, 3 Drawing Sheets

CONFORMAL ANTENNA ASSEMBLIES

TECHNICAL FIELD

This invention relates to antennas and more particularly to conformal antenna assemblies capable of picking up both UHF/VHF signals especially suitable for off-air reception of local television stations.

BACKGROUND ART

U.S. Pat. No. 5,363,114 assigned to the assignee of the present invention discloses planar or flat antennas in a serpentine array. The Yagi antenna is one most often in use to receive off-air (local channels) reception by the wireless cable industry and the digital satellite industry. The Yagi antenna is comprised of an array of tubular elements and a tubular base, does not have a thin profile and is not especially attractive or easy to mount.

German Patent No. 2,636,523 discloses a coaxial cable which also acts as a radiator of high frequency electromagnetic waves.

Wurdack U.S. Pat. No. 4,543,583 discloses a dipole antenna that has the jacket removed from a central portion to expose the outer conductor that is spread apart to form a gap exposing the dielectric layer.

Leidy U.S. Pat. No. 3,139,620 discloses a coaxial multiband antenna.

DISCLOSURE OF THE INVENTION

The present invention is an antenna including a relatively thin, flat, weather-resistant, conformal housing containing a first active antenna portion. The housing is shaped for conforming to the shape of either a flat wall mounting or to a mounting on the back of a double curved satellite dish. A cable connects to the feed end of the first active antenna portion and the cable has an outer tubular conductor ungrounded at one end to serve as both a second active antenna portion of a selected length and a signal carrier. The antenna assembly affords good off-air reception to pick up both UHF and VHF signals for wireless cable and satellite applications.

BRIEF DESCRIPTION OF THE DRAWINGS

Details of this invention are described in connection with the accompanying drawings which like parts bear similar reference numerals in which.

DETAILED DESCRIPTION

Figure 2:
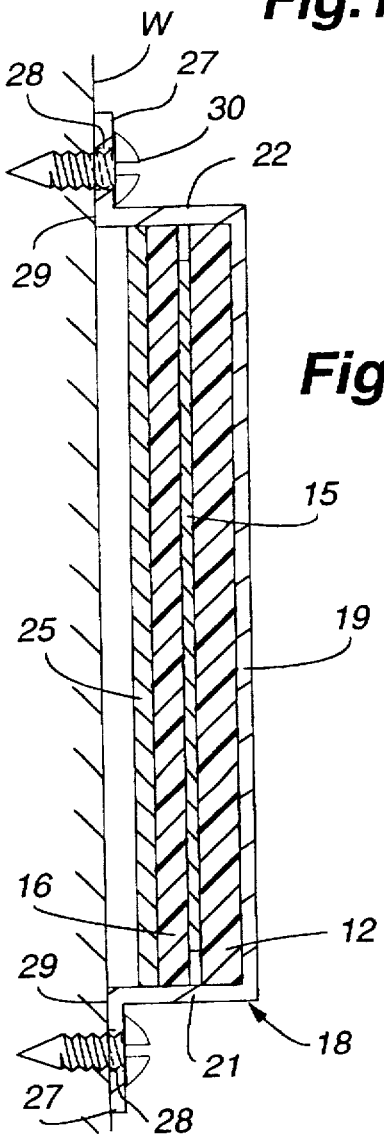
FIG. 2 is a sectional view taken along line 2—2 of FIG. 1.
Figure 3:
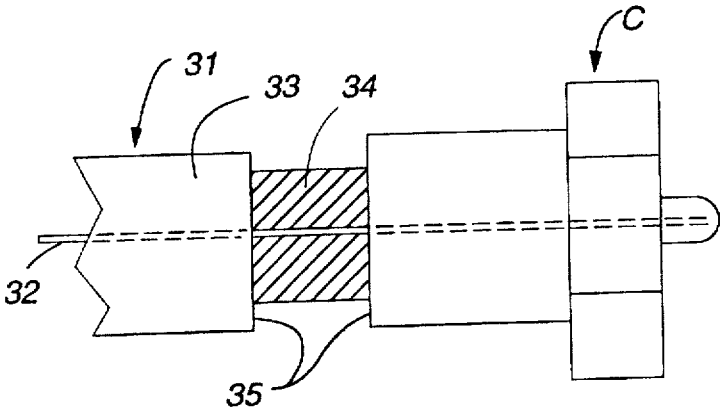
FIG. 3 is an enlarged elevation view of a coupling end of the cable shown in FIG. 2.

The antenna shown is a planar, serpentine type of the type shown in U.S. Pat. No. 5,363,114 and the disclosure of which is incorporated into the disclosure of this application by reference. The antenna assembly 11 shown in FIGS. 1–3 has a flat, rectangular-shaped, non-conductive (insulator) inner carrier layer 12, preferably of styrofoam plastic, on which there is mounted a first active antenna portion 13 including a first radiator 14 (strip conductor) in a serpentine pattern and a second radiator 15 (strip conductor) in a serpentine pattern. Each radiator has a feed end and an open end and a series of change of direction points along the length thereof with each change of direction point forming an electric discontinuity to provide more than one connected radiator section; The sections are perpendicular to one another to radiate energy in an omnidirectional pattern so that the currents in alignment with the E vector are those corresponding to horizontal and vertical polarizations as described in U.S. Pat. No. 5,363,114. A non-conductive (insulator) spacer layer 16, preferably of styrofoam plastic, is disposed against the radiator so the radiators are sandwiched between layer 12 and layer 16 to form an antenna sandwich.

The housing 18 shown is rectangular-shaped and has a flat front wall 19 and a straight top wall 21, a straight bottom wall 22 and a pair of opposed straight side walls 23 projecting away from the edges of the front wall 19. A back cover wall 25 fits inside walls 21 and 22 to enclose the antenna sandwich. A mounting flange 27 extends transverse or perpendicular to the outer edge of each of walls 21, 22 and 23 and has holes 28 to provide a means for mounting the housing to a supporting surface such as that shown as a flat side wall W of a building. The front wall 19, top wall 21, bottom wall 22, side walls 23 and flange 27 are molded to form a one-piece, rigid, plastic body, preferably from a ABS plastic, and is an environmentally protective weather-resistant layer or radome for the antenna sandwich. Back cover wall 25 is made of the same material as walls 21, 22 and 23 but is a separate plate that conforms in shape to the shape of the inside of the area bounded by walls 21, 22 and 23. The side walls 23 are short in relation to the front and back walls so as to provide a relatively thin, low profile housing for containing the antenna sandwich.

The flange 27 has a planar or flat conformal back surface 29 that conforms to the shape of the flat exterior wall surface and in this form is a flat wall as above described. Fastening screws 30 are shown as extending through the holes 28 for mounting the antenna housing to the side wall W.

A cable 31 is connected at one end to the antenna radiators 13 and 14 and the other end has a conventional terminal connector C with a male plug at the end. Cable 31 is a coaxial cable having a center conductor 32 and a tubular outer conductor 33 with an insulator 34 between the two conductors. Antenna radiator 13 connects at a feed end to one end of the center conductor 32 and antenna radiator 14 connects at a feed end to one end of the outer conductor 33. A portion of the outer conductor 33 at the terminal end at connector C is removed to form a gap 35 so that the outer conductor is ungrounded at the terminal end. The other end of the center conductor 32 connects at a terminal end to the male plug of the feed terminal connector C.

Figure 4:
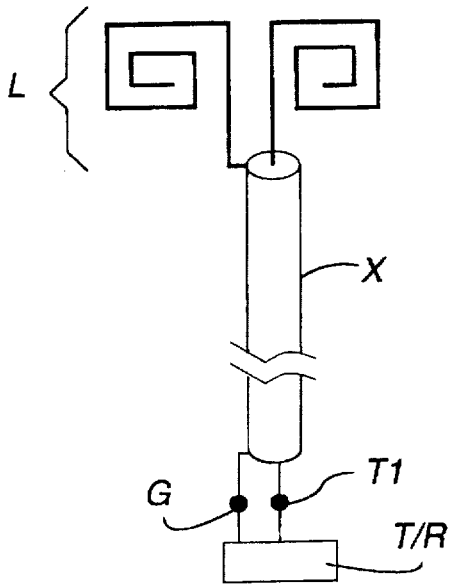
FIG. 4 is a schematic diagram of a prior art antenna with the typical coaxial cable-antenna connection.

Referring now to FIG. 4 there is shown a schematic diagram of a prior art antenna having a typical coaxial cable-antenna connection in which the cable does not form a part of the active portion of the antenna. There is shown the active antenna portion having a length designated by L, a coaxial cable X with the center conductor having a feed terminal T1 and a ground terminal G connected to the end of the outer tubular portion of the coaxial cable. A transmitter/receiver TR is shown connected to terminals T1 and G.

According to the present invention the active antenna portion 13 has a length LA and the coaxial cable a length LB and the two lengths LA plus LB form the length of the antenna designated L1. This total length L1 for the present invention is 10 feet. The length LA of the first active antenna portion is particularly sensitive to the UHF frequencies of about 350 MHz to 900 MHz. The length of LB is particularly sensitive to the VHF frequencies of about 50 MHz to 350 MHz. There is some overlap in frequencies of each of these lengths LA and LB. In this way the conductors 32 and 33 of the cable 31 are used as a second active antenna portion in combination with the first active antenna portion and this arrangement has been found to pick up local stations for UHF/VHF signals. The terminal end T2 of the center conductor can be connected to a cable CA and/or to a transmitter/receiver TR.

Referring now to FIGS. 6 through 9 there is shown a second embodiment of an antenna assembly 41 that mounts to the back of a double curved satellite dish D. This antenna assembly 41 has a non-conductive (insulator) inner carrier layer 42, preferably of styrofoam plastic, and a first active antenna portion 43 including a first radiator 44 in a serpentine pattern and a second radiator 45 in a serpentine pattern mounted on the carrier layer 42 with a spacer layer 46, preferably of styrofoam plastic, against the radiators so that the radiators are sandwiched between the layers 42 and 46 to form an antenna sandwich similar to the antenna sandwich of the first described embodiment.

The housing 48 shown is generally mushroom shaped, having a double curved front wall 49, curved top wall 51, straight bottom wall 52, opposed, spaced, curved side walls 53 extending perpendicular to the outer edge of the front wall and a flange 57 extending transversely to and out from the peripheral edges of walls 49, 51, 52 and 53. The flange 57 has a conformal back surface 59 that is double curved to conform to the shape of the plate 61 on which it rests and the back surface of the dish D. This housing 48 is preferably a one-piece molded plastic rigid body of a weather-resistant material similar to the outer housing 18 above described in connection with FIG. 1. The housing 48 has a inverted U-shaped section in the bottom wall that allows the cable 71 to extend therethrough. The housing 48 is mounted on a double curved backing plate 61 having an upper portion 61A with the same shape as the housing and a rectangular shaped lower plate portion 61B. The front wall 48 and backing plate 61 are seen to be curved both longitudinally (up and down) and laterally (side to side) in FIG. 9 so as to have a double curve. This plate 61 is made of the same rigid, plastic, weather-resistant material as the housing 48 and has a shape conforming to the shape of the back of the double curved dish D against which it is mounted. An elongated vertical slot 62 is provided in a central part of the backing plate and four holes 63 are provided as a means for mounting the assembly to the dish. The lower edge of the lower plate is the same radius as the housing 48.

Figure 1:
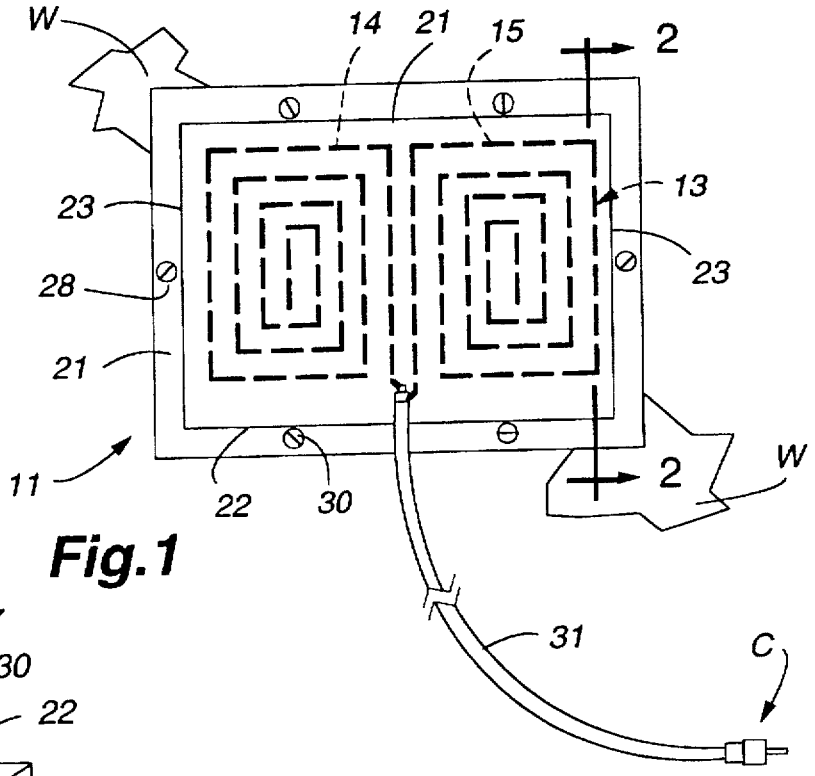
FIG. 1 is a rear elevation view of a first embodiment of a conformal antenna assembly embodying features of the present invention shown mounted on a flat, vertical wall.
Figure 5:
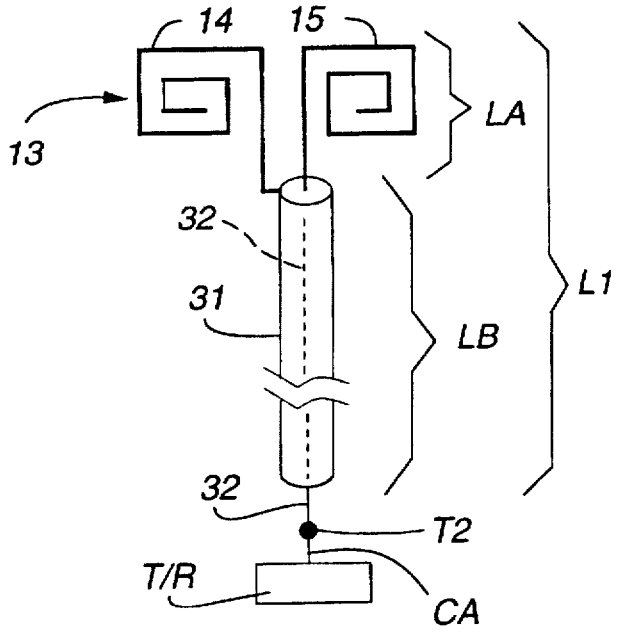
FIG. 5 is a schematic diagram of an antenna connection embodying features of the present invention.
Figure 6:
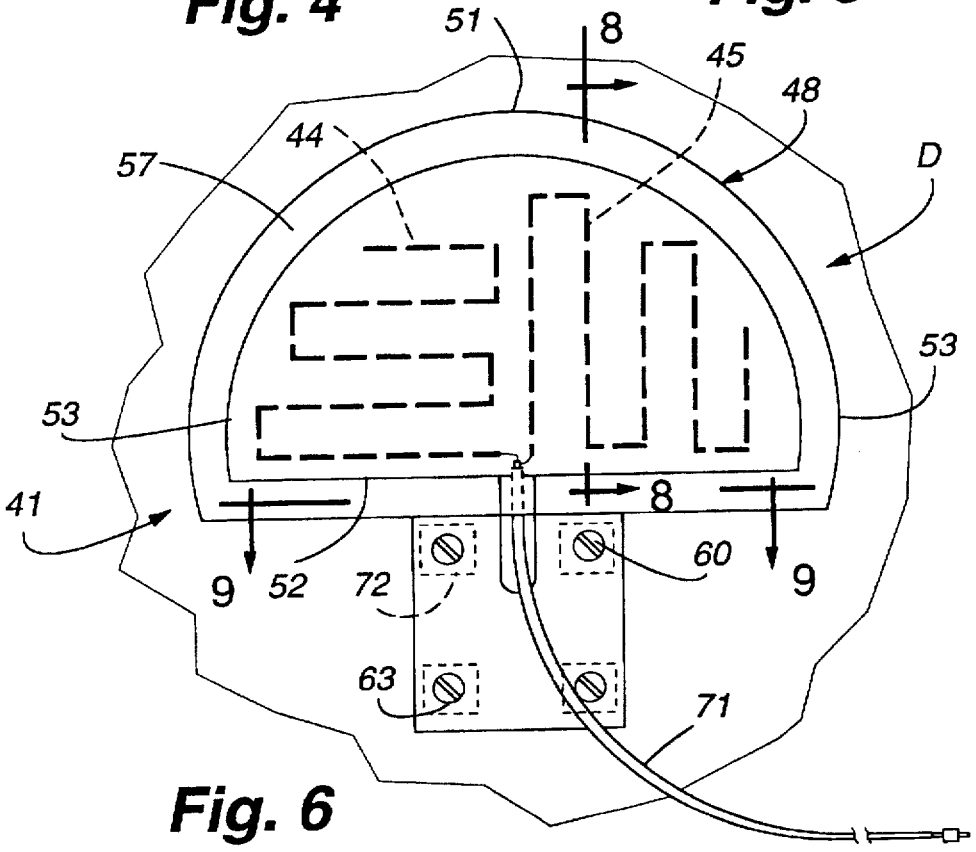
FIG. 6 is a rear elevation view of a second embodiment of an antenna embodying features of the present invention shown mounted on the back of a double curved satellite dish.
Figure 7:
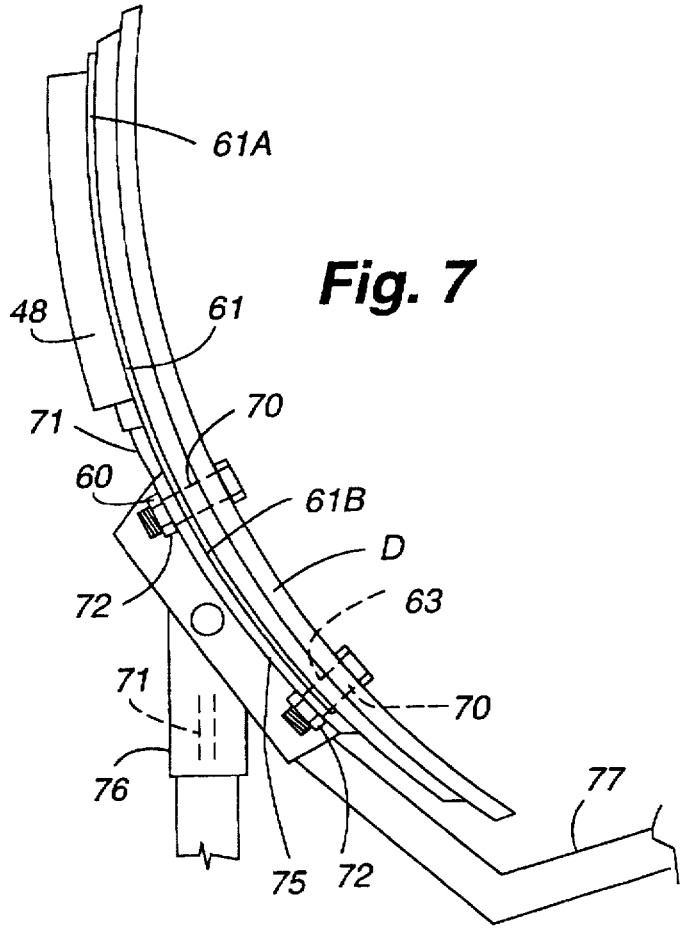
FIG. 7 is a side elevation view of the conformal antenna assembly of FIG. 6 shown mounted on the back surface of a double curved satellite dish.
Figure 8:
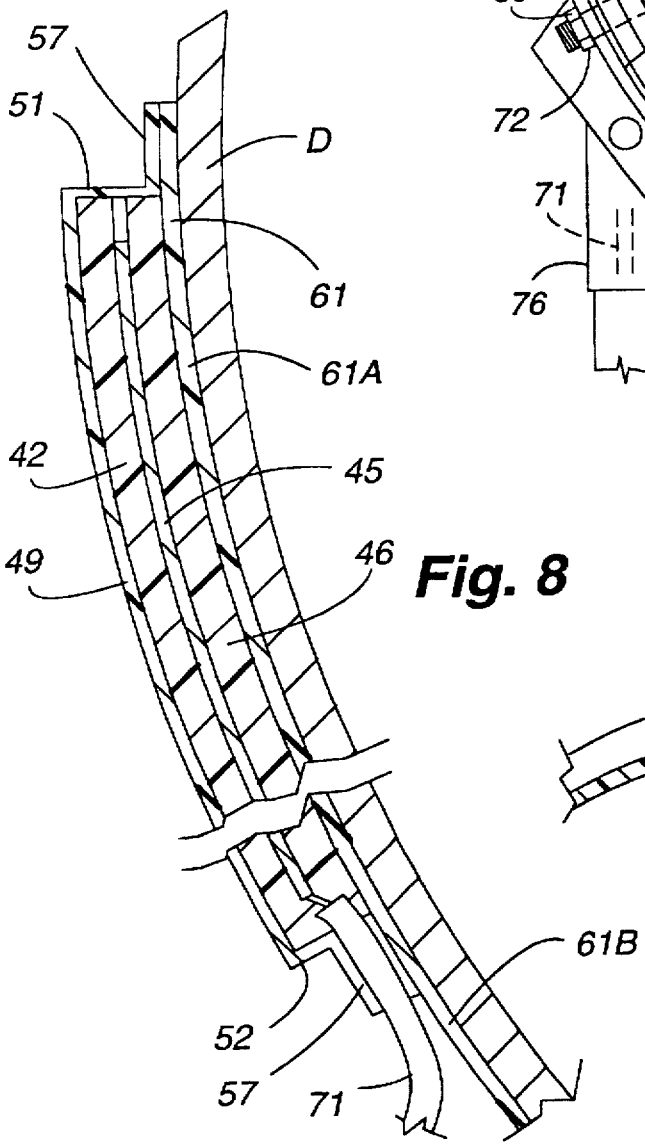
FIG. 8 is an enlarged sectional view taken along line 8—8 of FIG. 6.
Figure 9:
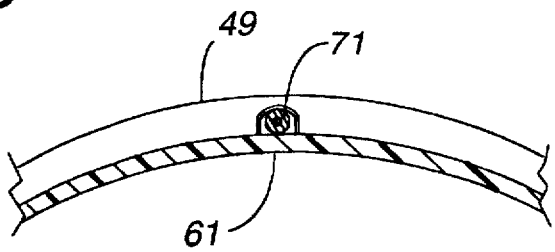
FIG. 9 is a sectional view taken along line 9—9 of FIG. 6.

A cable 71 is connected at one end to the two antenna radiators and the construction and connection of this cable is the same as cable 31 shown in FIG. 1 so that the center and outer conductors of the cable form a second active portion of the antenna as described in connection with FIG. 5. The bolts 70 already found on the satellite dish D extend through the four holes 63 in the mounting plate as shown and nuts 73 are threaded on the bolts. The housing containing the antenna mounts directly on and is flush and conformal with the back of the support structure of the satellite dish D. Support structure or support arm 75 for the dish has the bolts extending therethrough with the nuts bearing against the support arm.

A conduit 76 extending from the support arm 75 carries cable 71 and a second conduit 77 carries signals to and from the transmitter/receiver in the dish.

Although the present invention has been described with a certain degree of particularity, it is understood that the present disclosure has been made by way of example and that changes in details of structure may be made without departing from the spirit thereof.

What is claimed is:

1. A conformal antenna assembly comprising:

a first antenna portion sensitive to a selected first band of frequencies, a housing enclosing said first antenna portion, said housing having a conformal back surface that conforms to the shape of a support surface on which said housing is mounted, said housing having means to mount said housing to said support surface, and cable means having a center conductor and a tubular outer conductor with an insulator between said conductors, said center conductor and outer conductor connected at one end to said first antenna portion, said center conductor terminating at the other end in an end terminal to conduct signals from said first antenna portion to said end terminal, said outer conductor having a gap which ungrounds said outer conductor at said end terminal whereby said center and outer conductors are a second antenna portion sensitive to a selected second band of frequencies in combination with said first antenna portion for sensitivity to both of said first and second bands of frequencies.

2. The assembly as set forth in claim 1 wherein said first antenna portion is in the form of first and second flat radiators of a thin, flat, conductive material, each said radiator arranged in a serpentine pattern having a feed end and an open end and a series of change of direction points along the length thereof.

3. The assembly as set forth in claim 1 wherein said first antenna portion is mounted on a non-conductive carrier layer and are covered by a non-conductive spacer layer to form an antenna sandwich.

4. The assembly as set forth in claim 1 wherein said housing is rectangular-shaped and is flat.

5. The assembly as set forth in claim 1 wherein said housing is mushroom-shaped and is double curved by having longitudinally and laterally curved surfaces.

6. The assembly as set forth in claim 1 wherein said housing has a flat front wall, straight top wall, straight bottom wall, and a pair of opposed, spaced, straight side walls together with a mounting flange extending transverse to an outer edge of said walls, said flange having a flat conformal surface to conform to a flat surface of a support on which the housing is mounted.

7. The antenna as set forth in claim 6 wherein said first antenna portion is mounted on a non-conductive carrier layer and covered by a non-conductive spacer layer to form an antenna sandwich and a back wall inside said top, bottom and side walls to enclose said antenna sandwich in a closed housing.

8. The assembly as set forth in claim 1 wherein said housing is made of a molded, one-piece, rigid, weather-resistant material.

9. The assembly as set forth in claim 8 wherein said material is an ABS plastic.

10. The assembly as set forth in claim 1 wherein said cable means is a coaxial cable with a combined length of said first and second antenna portions being about 10 feet.

11. The antenna assembly as set forth in claim 1 wherein said first band of frequencies is a UHF band of about 350 MHz to 900 MHz and said second band of frequencies is a VHF band having a band of about 50 MHz to 350 MHz.

12. A conformal antenna assembly comprising:

a first antenna portion sensitive to a selected first band of frequencies, a thin, flat, low-profile, weather-resistant housing enclosing said first antenna portion, said housing having a conformal back surface that conforms to the back of a double-curve surface of a satellite dish, said housing having means to mount said housing to said double-curve surface, and a cable having a center conductor and a tubular outer conductor with an insulator between said conductors, said center conductor and outer conductor connected at one end to said first antenna portion, said conductor terminating at the other end in an end terminal to conduct signals from said first antenna portion to said end terminal, said outer conductor having a gap which ungrounds said outer conductor at said end terminal whereby said center and outer conductors are a second antenna portion sensitive to a selected second band of frequencies in combination with said first antenna portion for sensitivity to both of said first and second bands of frequencies.

13. A conformal antenna assembly comprising:

a first antenna portion sensitive to a selected first band of frequencies, a thin, flat, low-profile, weather-resistant housing enclosing said first antenna portion, said housing having a flat conformal back surface that conforms to the flat shape of a flat wall of a building, said housing having means to mount said housing to said flat wall, and a cable having a center conductor and a tubular outer conductor with a dielectric between said conductors, said center conductor and outer conductor connected at one end to said first antenna portion, said center conductor terminating at the other end in an end terminal to conduct signals from said first antenna portion to said end terminal, said outer conductor having a gap which ungrounds said outer conductor at said end terminal whereby said outer conductor is a second antenna portion sensitive to a selected second band of frequencies in combination with said first antenna portion to pick up local stations for both UHF and VHF signals.

14. An antenna assembly comprising:

a first antenna portion sensitive to a selected first band of frequencies, cable means having a center conductor and a tubular outer conductor with an insulator between said conductors, said center conductor and outer conductor connected at one end to said first antenna portion, said center conductor terminating at the other end in an end terminal to conduct signals from said first antenna portion to said end terminal, said outer conductor having a gap which ungrounds said outer conductor at said end terminal whereby said center and outer conductors are a second antenna portion sensitive to a selected second band of frequencies in combination with said first antenna portion for sensitivity to both of said first and second bands of frequencies.

15. A conformal antenna assembly comprising:

a first antenna portion sensitive to a selected first band of frequencies, a housing enclosing said first antenna portion, said housing having a double-curve front wall, curved top wall, straight bottom wall and opposed, curved, side walls and is disposed on a double-curve backing plate that conforms to a double-curve surface at the back of a satellite dish, said backing plate having an upper portion conforming to the shape of said housing and a lower rectangular-shaped portion having apertures to provide a means to mount said housing to said satellite dish, and cable means having a center conductor and a tubular outer conductor with an insulator between said conductors, said center conductor and outer conductor connected at one end to said first antenna portion, said center conductor terminating at the other end in an end terminal to conduct signals from said first antenna portion to said end terminal, said outer conductor having a gap which ungrounds said outer conductor at said end terminal whereby said center and outer conductors are a second antenna portion sensitive to a selected second band of frequencies in combination with said first antenna portion for sensitivity to both of said first and second bands of frequencies.

16. The assembly as set forth in claim 15 wherein said first antenna portion is supported on a non-conductive carrier layer and are covered by a non-conductive spacer layer to form an antenna sandwich, said upper portion enclosing said sandwich in an enclosed housing.

17. A conformal antenna assembly comprising:

a first antenna portion sensitive to a selected first band of frequencies, a housing enclosing said first antenna portion, said housing having a front housing portion and a back housing portion, said front housing portion including a flat front wall, straight top wall, straight bottom wall, a pair of opposed, spaced, straight side walls, a mounting flange extending transverse to an outer edge of said top, side and bottom walls, said flange having a flat conformal surface to conform to a flat support surface to mount said housing to said flat support surface, and cable means having a center conductor and a tubular outer conductor with an insulator between said conductors, said center conductor and outer conductor connected at one end to said first antenna portion, said center conductor terminating at the other end in an end terminal to conduct signals from said first antenna portion to said end terminal, said outer conductor having a gap which ungrounds said outer conductor at said end terminal whereby said center and outer conductors are a second antenna portion sensitive to a selected second band of frequencies in combination with said first antenna portion for sensitivity to both of said first and second bands of frequencies.

18. A conformal antenna assembly for mounting to a double-curve back surface of a satellite dish comprising:

a double-curve housing defining an inner cavity, said housing having a double-curve back surface conformal to the back double-curve surface of the satellite dish, said housing having means to mount said housing to the back of said satellite dish, said housing having a front housing portion and a back housing portion, said front housing portion including a double-curve front wall, curved top wall, straight bottom wall, and a pair of opposed curved side walls defining said cavity opening away from said front wall, said means to mount including a mounting flange extending transverse to an outer edge of said top, bottom and side walls, said flange having a double-curve surface conformal to the back surface of said satellite dish, and an antenna radiator in said inner cavity and enclosed in said housing.

* * * * *